US006116757A

United States Patent [19]

Simon

[11] Patent Number: 6,116,757

[45] **Date of Patent: *Sep. 12, 2000**

[54] DECORATIVE ILLUMINATION SYSTEM

[76] Inventor: Jerome H. Simon, 70 Sumner St., Newton Centre, Mass. 02159

[ * ] Notice: This patent is subject to a terminal disclaimer.

[21] Appl. No.: 09/081,977

[22] Filed: May 15, 1998

Related U.S. Application Data

[63] Continuation of application No. 08/621,308, Mar. 25, 1996, Pat. No. 5,863,115, which is a continuation of application No. 08/237,555, May 3, 1994, abandoned.

[51] Int. Cl.[7] ..... F21V 5/02

[52] U.S. Cl. ..... 362/332; 362/336; 362/337; 362/338; 362/340; 362/404

[58] Field of Search ..... 362/310, 311, 362/147, 338, 339, 326, 337, 332, 336, 340, 404, 806

[56] References Cited

U.S. PATENT DOCUMENTS

| | | | |
|---|---|---|---|
| 182,668 | 9/1876 | Hobbs | 362/340 |
| 967,029 | 6/1910 | Mygatt | 362/339 |
| 1,042,463 | 7/1912 | Mygatt | 362/340 |
| 1,894,583 | 1/1933 | Ferree et al. | 362/404 |
| 4,118,763 | 10/1978 | Osteen | 362/339 |
| 4,459,643 | 7/1984 | Mori | 362/224 |
| 4,575,786 | 3/1986 | Roberts | 362/281 |
| 4,858,091 | 8/1989 | Fouke | 362/337 |
| 5,095,415 | 3/1992 | Anderson et al. | 362/337 |
| 5,317,493 | 5/1994 | Muller et al. | 362/404 |

*Primary Examiner*—Thomas M. Sember
*Attorney, Agent, or Firm*—Perkins, Smith & Cohen; Harvey Kaye; Jerry Cohen

[57] ABSTRACT

An illumination system with a light source and a surrounding cylindrical array of refracting elements producing spokes of light on adjacent surfaces.

11 Claims, 4 Drawing Sheets

DECORATIVE ILLUMINATION SYSTEM

CROSS-REFERENCE TO RELATED APPLICATIONS

The present application is a continuation of co-pending application Ser. No. 08/621,308 filed Mar. 25, 1996, now U.S. Pat. No. 5,863,115 which was a continuation of application Ser. No. 08/237,555 filed May 3, 1994, now abandoned.

FIELD AND BACKGROUND OF THE INVENTION

The present invention relates to decorative illumination.

The lighting industry could benefit from effective systems that would contribute architectural/decorative values in original and rehab' constructions and in redecoration of interior and exterior spaces.

SUMMARY OF THE INVENTION

A lighting product which can be mounted to an architectural surface such as a wall or column (such as a sconce) or be suspended as a pendant which provides a decorative pattern in the form of radiant spokes of light which act as direct or indirect illumination. This device provides useful illumination and at the same time provides decoration which may substitute for painted or wall-papered decoration.

It is an object of the present invention to provide an efficient means for decorative lighting whereby a decorative pattern is formed by a series of rays from a light source where substantially all the radiant flux of the source is used for illumination.

Briefly stated, in accordance with the present invention, a cylindrical body surrounds a light source and is comprised of a series of adjacent, axially extending retracting elements. The cross-section of the cylinder tray comprise a curve polyhedron or irregular shape.

The means by which the foregoing objects and features of the invention are achieved are pointed out in the claims forming the concluding portion of the specification. The invention, both as to its organization and manner of operation, may further be understood by reference to the following description taken in connection with the drawings.

DETAILED DESCRIPTION OF PREFERRED EMBODIMENTS

Figure 1:
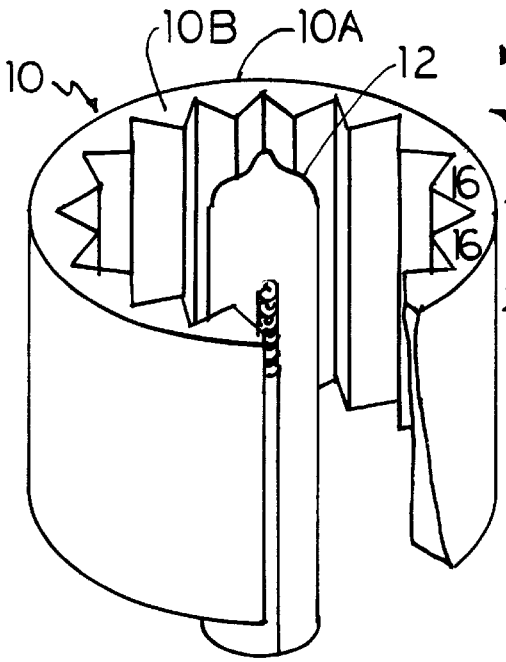
FIG. 1 is an isometric view, partially cut-away, of an illumination system which includes a quasi-point source within a cylinder of prism refractors.
Figure 1A:
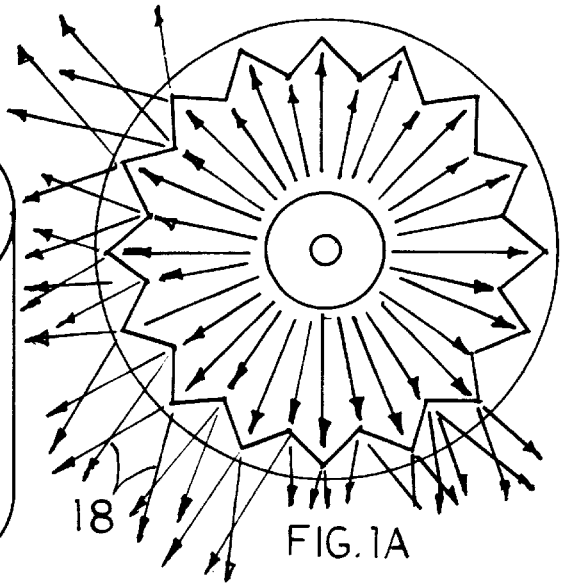
FIG. 1A is a plan view of the illumination system of FIG. 1 showing the type of spoke pattern produced thereby.

Referring now to the drawings, FIGS. 1 and 1A show a source of light within a cylinder of prism refractors. The source is located in an axial position so that a large portion of the flux is directed toward an adjacent surface. The illumination system 10 comprises an axially elongated light source 12, such as an incandescent lamp (quartz/halogen), surrounded by a cylindrical array of refractive elements of, typically, 60–90 degree prisms (in the FIGS. 1 case, 90 degrees). Spoke rays of light 18 (FIG. 1A) emerge from the system in a cross-hatched pattern including portions of the spokes that are angularly offset from radial by 1 to 89 degrees (plus or minus) typically 22.5 to 60 degrees.

Figure 2:
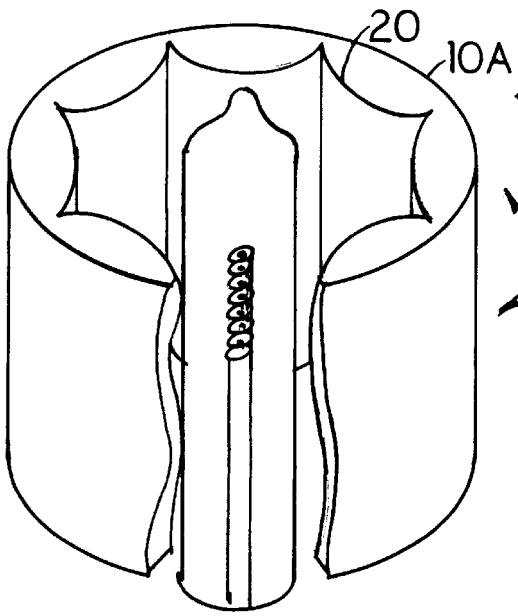
FIG. 2 is an isometric view, partially cut-away, of an illumination system which includes a quasi point source within a cylinder of convex cylinder lenses.
Figure 2A:
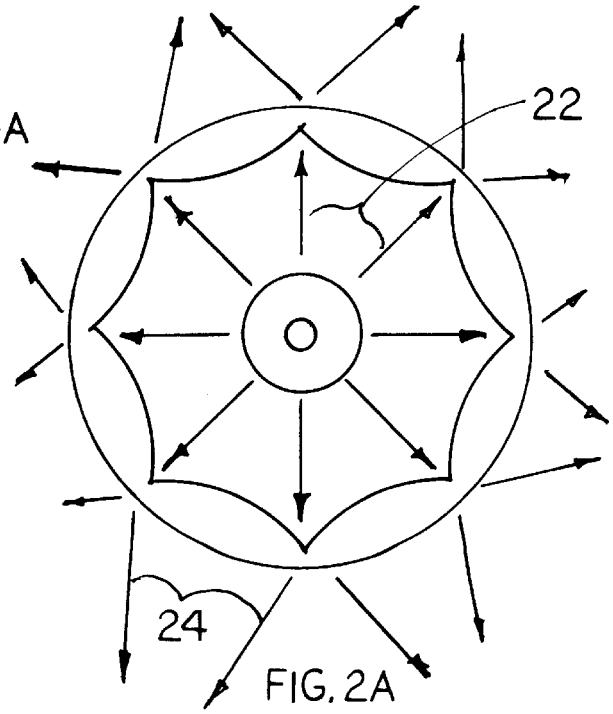
FIG. 2A is a plan view of the illumination system of FIG. 2 showing the type of spoke pattern produced thereby.

FIGS. 2 and 2A show a variant of the embodiment of FIGS. 1. In FIGS. 2 prism surface 16 of FIGS. 1 has been replaced by convex surface 20 forming a positive cylindrical lens with surface 10A. This cylindrical lens focuses the radiating light 22 from the source 12 into substantially triangular shaped radial beams 24.

Figure 3:
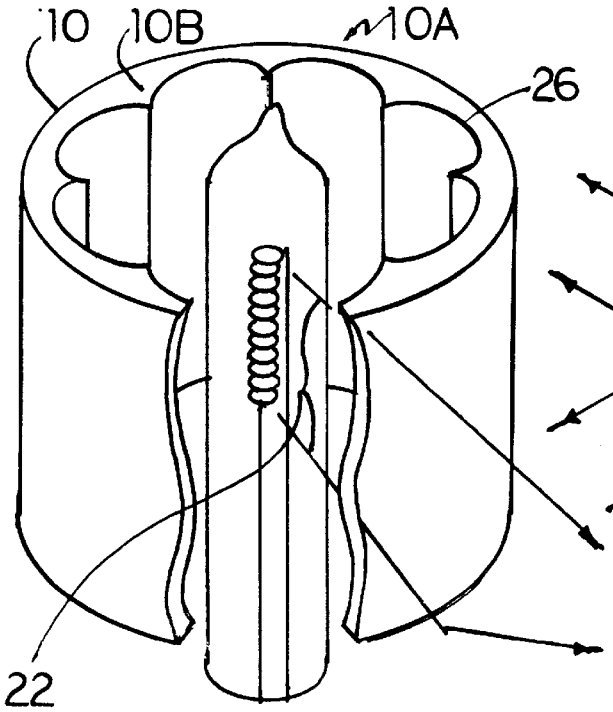
FIG. 3 is an isometric view, partially cut-away, of an illumination system which includes a quasi-point source within a cylinder of concave cylinder lenses.
Figure 3A:
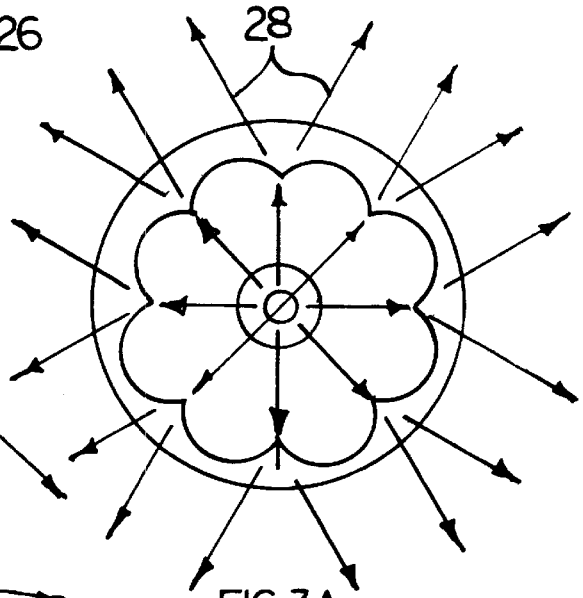
FIG. 3A is a plan view of the illumination system of FIG. 3A showing the type of spoke pattern produced thereby.

FIGS. 3 show a further variant. Surface 20 (FIG. 2) is a concave surface 26 forming a negative cylinder lens with surface 10A; this results in the radiating light 22 from source 12 leaving surface 10A at an increased angle of divergence to form bright, overlapping light spokes 28. FIG. 3A also shows that by placing source 12 towards the top of the cylinder 10B, radiating light 22 is further directed to an adjacent architectural surface (e.g. floor, wall, surface, ceiling, divider panel, etc.)

Figure 4:
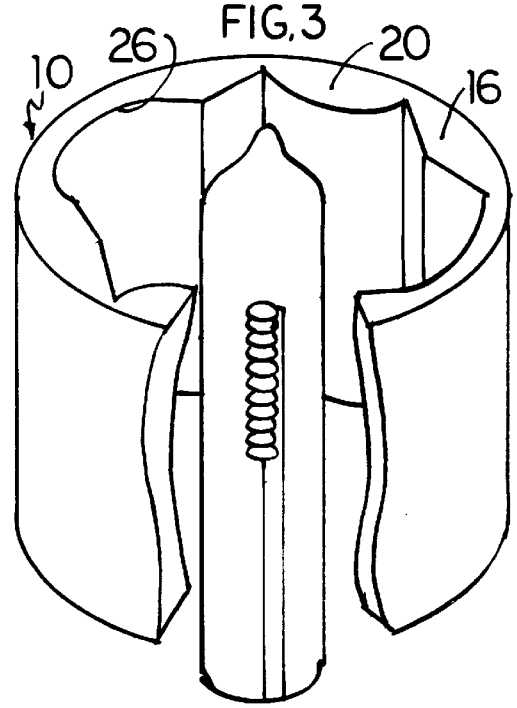
FIG. 4 is an isometric view, partially cut-away, of an illumination system which includes a quasi-point source within a cylinder of a mix of prisms, convex cylindrical lenses and concave cylindrical lenses.
Figure 4A:
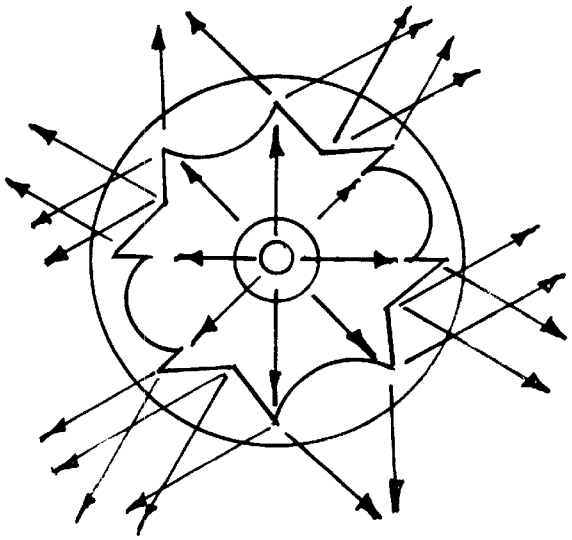
FIG. 4A is a plan view of the illumination system of FIG. 4A showing the type of spoke pattern produced thereby.

FIGS. 4 show a further variant in that the cylinder 10B is comprised of a combination of prisms 16, convex surfaces 20 and concave surfaces 26. The radiant energy 22 from source 12 forms a mix of spokes 18 (FIG. 1A), 24 (FIG. 2A) and 28 (FIG. 3B).

Figure 5:
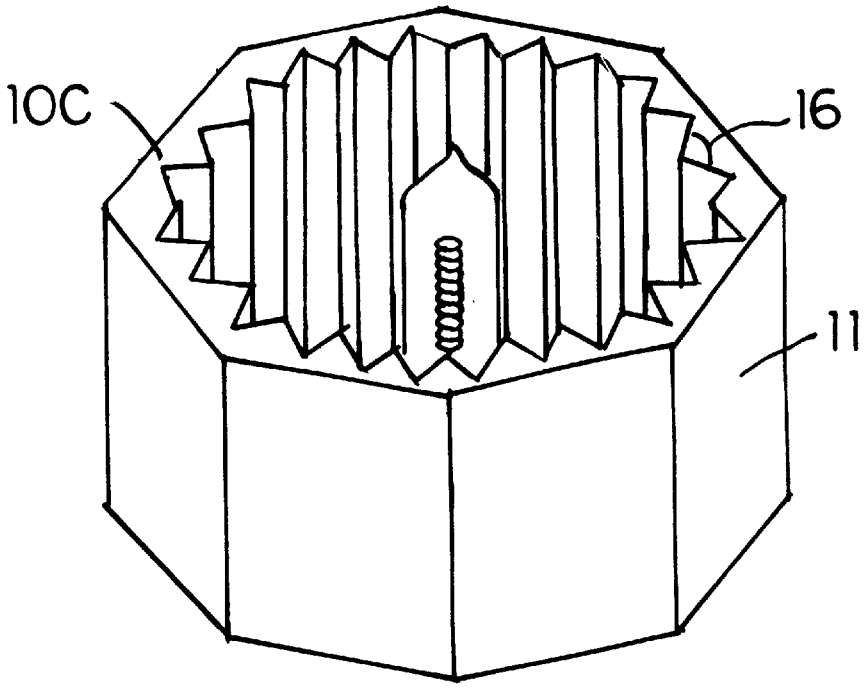
FIG. 5 is an isometric view of an illumination system which includes a quasi-point source with a cylinder of faces of flat outside contours forming a polyhedron.

FIG. 5 shows a variant in that the cylinder 10B (FIG. 1) has been altered to be a cylindrical polyhedron 10C formed by prisms 16 and flat faces 11.

Figure 6:
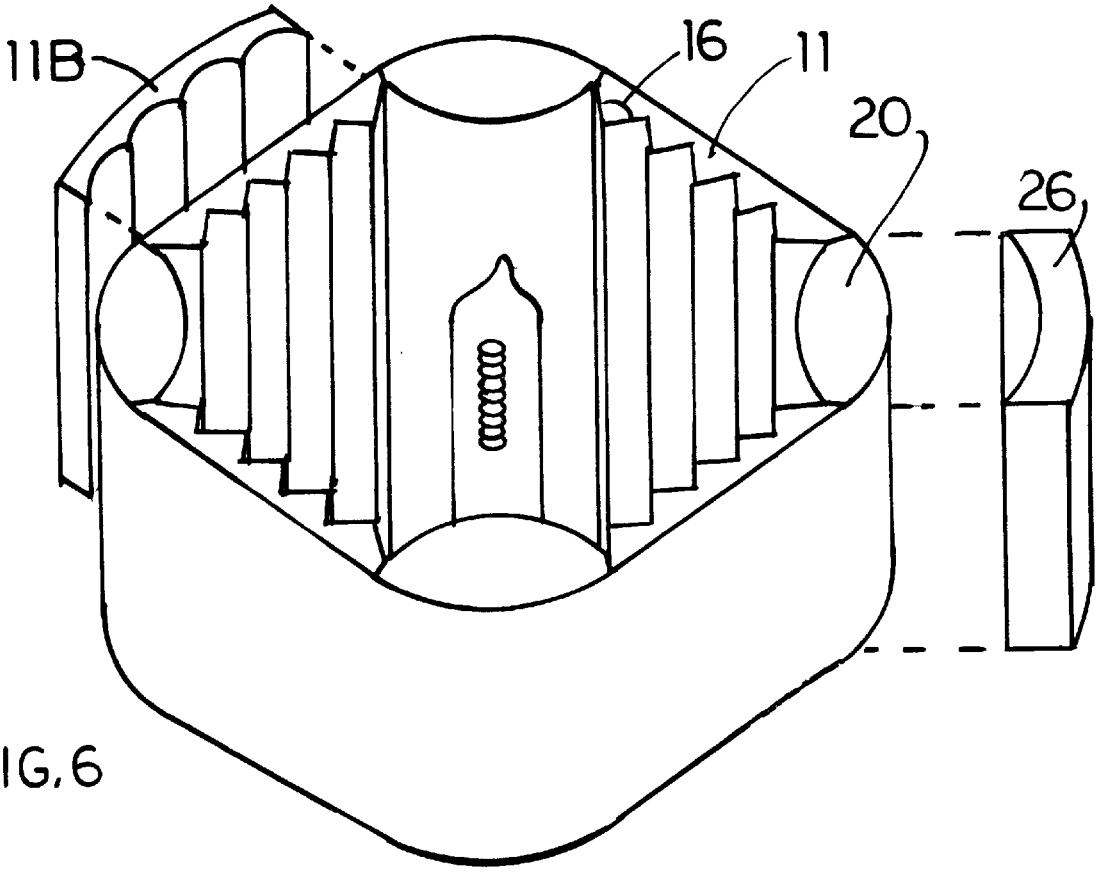
FIG. 6 is an isometric view of an illumination system which includes a quasi-point source surrounded by a polyhedron of differing refracting devices with varied outside contours, with various sections thereof containing differing outside contours and refracting devices and being interchangeable.

FIG. 6 shows a variant of FIG. 5 in that the polyhedron 10C is alternatively constructed of plates 11 and positive cylinders 20 and may be removed and replaced by plate 11B and convex lens 26, respectively.

Figure 7:
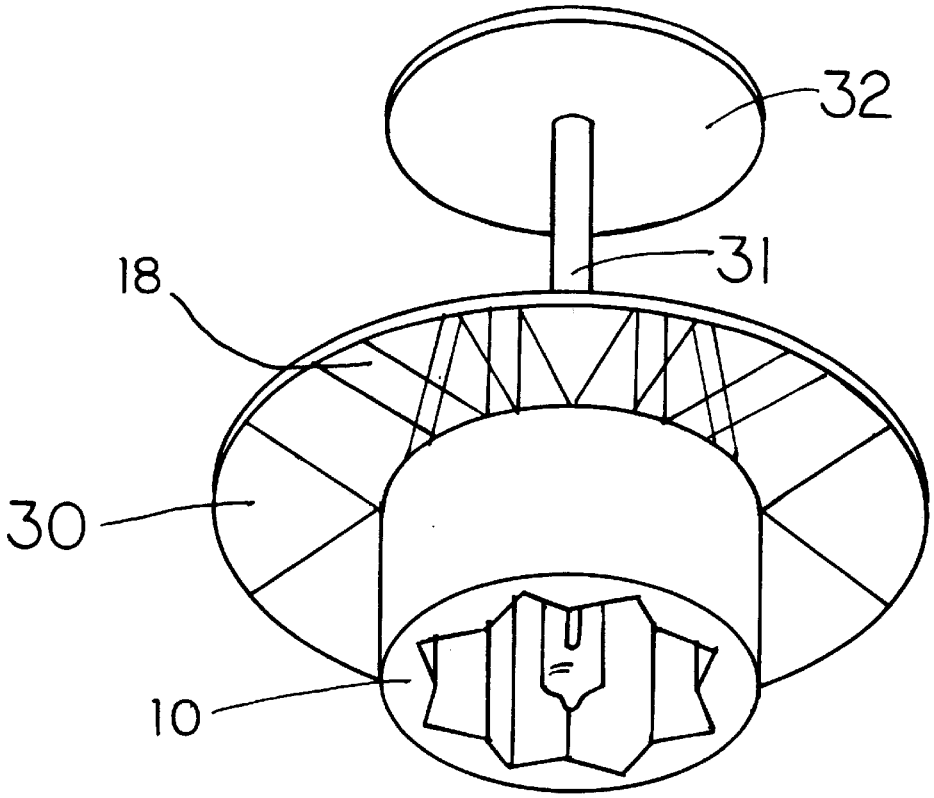
FIG. 7 is an isometric view of an illumination system which includes a quasi-point source surrounded by a cylinder of prisms with a supported surface to receive spokes of light.

FIG. 7 shows an illumination system 10 screen attached to plate 30 that acts to receive ray spokes 18. Further, this combined illuminating system 10 and plate 30 may be suspended by rod 31 and canopy 32 which are used to attach 10 to an architectural surface.

Figure 8:
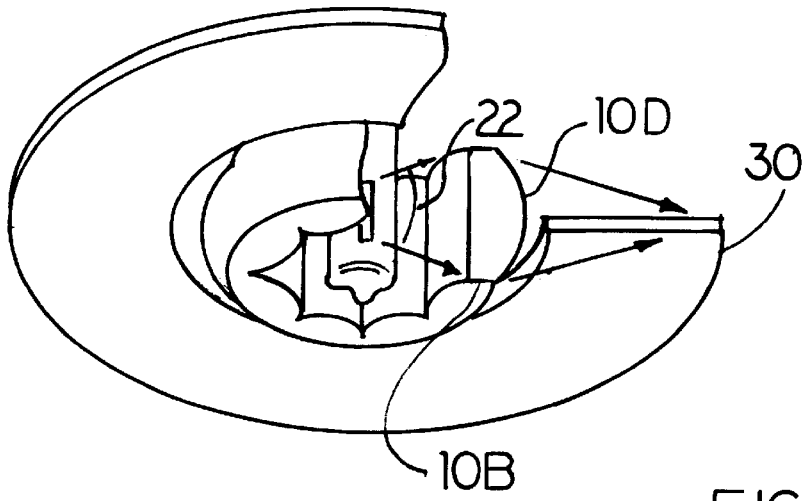
FIG. 8 is an isometric view, partially cut-away, of an illumination system which includes a quasi-point source surrounded by a cylinder of positive cylinder lens with the outer surface contoured in the form of a convex refractive ring and showing a cross-section of the light within the spikes being focused on an adjacent surface.

FIG. 8 shows a further variant of FIG. 7 in that the outside face of cylinder10B (FIG. 1) is formed as a convex surface 10D to focus radiant light 22 towards plate 30.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

I claim:

1. An illumination system for creating patterns of light on an adjacent surface comprising:

a quasi point light source, a plate having a surface onto which patterns of light are to be formed, and a cylindrical refracting means surrounding the source radially and disposed adjacent to said plate, said cylindrical means including substantially axially elongated refracting elements the refracting portions of which are on the inner surface thereof and directly facing said source for refracting light traveling from said source into elongated spokes of light extending outwardly towards the surface on said plate which is adjacent said refracting means and creating spokes of light on such surface, said quasi point source being positioned with respect to said cylindrical means so that a substantial portion of flux from said quasi point source is refracted by said cylinder in a direction angularly offset from a radial direction towards the adjacent surface to produce visible patterns of light on the surface.

2. The system of claim 1 wherein the interior of the cylindrical means is contoured in the axial direction to form a focusing ring to direct the spokes of light towards an adjacent surface.

3. The system of claim 1 wherein said surface is supported on said cylindrical means and is positioned to receive the spokes of light on the supported surface.

4. The system of claim 1 wherein said cylindrical means comprises an array of lineal prisms.

5. The system of claim 1 wherein said cylinder comprises convex cylindrical lenses.

6. The system of claim 1 wherein said cylinder comprises concave cylindrical lenses.

7. The system of claim 1 wherein said cylinder comprises a mixture of prisms, convex and concave cylindrical lenses.

8. The system of claim 1 wherein said cylindrical means is formed to have a preselected polyhedral cross section.

9. The system of claim 1 wherein said cylindrical means comprises interchangeable sections, each section having a selected contour.

10. The system of claim 1 wherein at least one of said refracting elements is removably connected to said cylindrical means.

11. The system of claim 1 wherein a plurality of said refracting elements are removably connected to said cylindrical means.

* * * * *